US007647978B2

(12) United States Patent
Scott

(10) Patent No.: US 7,647,978 B2
(45) Date of Patent: Jan. 19, 2010

(54) PERFORATING GUN CONNECTOR

(76) Inventor: Bruce David Scott, 26412 C.R. 1600, Stonewall, OK (US) 74871

( * ) Notice: Subject to any disclaimer, the term of this patent is extended or adjusted under 35 U.S.C. 154(b) by 0 days.

(21) Appl. No.: 11/899,796

(22) Filed: Sep. 7, 2007

(65) Prior Publication Data

US 2008/0035373 A1 Feb. 14, 2008

Related U.S. Application Data

(62) Division of application No. 10/910,874, filed on Aug. 4, 2004, now Pat. No. 7,278,491.

(51) Int. Cl.
*E21B 19/16* (2006.01)

(52) U.S. Cl. ..... 166/380; 285/402

(58) Field of Classification Search ..... 166/55, 166/55.2, 380, 297; 102/312; 285/33, 39, 285/402

See application file for complete search history.

(56) References Cited

U.S. PATENT DOCUMENTS

| | | | | |
|---|---|---|---|---|
| 3,465,836 A | | 9/1969 | Fields | |
| 3,923,105 A | | 12/1975 | Lands | |
| 3,923,106 A | | 12/1975 | Bosse-Platiere | |
| 4,509,604 A | | 4/1985 | Upchurch | |
| 4,523,649 A | | 6/1985 | Stout | |
| 4,744,424 A | | 5/1988 | Lendermon et al. | |
| 5,020,591 A | | 6/1991 | Shore | |
| 5,584,512 A | * | 12/1996 | Carstensen | 285/55 |
| 5,743,333 A | * | 4/1998 | Willauer et al. | 166/122 |
| 5,746,555 A | * | 5/1998 | McEvoy | 411/14 |
| 6,397,752 B1 | | 6/2002 | Yang et al. | |
| 2005/0206160 A1 | | 9/2005 | Ericksen et al. | |

* cited by examiner

*Primary Examiner*—Jennifer H Gay
*Assistant Examiner*—Daniel P Stephenson
(74) *Attorney, Agent, or Firm*—W. Allen Marcontell

(57) ABSTRACT

Controlled Buoyancy Perforating technology for highly deviated and substantially horizontal wellbores may include long perforating guns assembled on a rig floor from a multiplicity of light weight and highly engineered shaped charge carrier joints. Tubular housings for such light weight joints may be fabricated from composite materials having steel transition collars. The collars are designed for an angularly coordinated, bayonet assembly and, in most cases, rapid disassembly. The internal volume of each joint is environmentally sealed by a plurality of O-rings. Sleeves that overlap abutting ends of adjacent carrier joint housings are secured by snap rings. Set screws into the sleeve ring channels release the sleeve from a housing. Individual shaped charge units and cooperative fusing are assembled in a light weight inner loading tube having an alignment collar to secure the angular and axial position of the loading tube relative to the transition collars.

11 Claims, 13 Drawing Sheets

PERFORATING GUN CONNECTOR

CROSS-REFERENCE TO RELATED APPLICATIONS

This application is a Division of U.S. patent application Ser. No. 10/910,874 filed Aug. 4, 2004, now U.S. Pat. No. 7,278,491 issued Oct. 9, 2007.

STATEMENT REGARDING FEDERALLY SPONSORED RESEARCH OR DEVELOPMENT

Not Applicable

BACKGROUND OF THE INVENTION

1. Field of the Invention

This invention generally relates to downhole well tools and specifically to controlled buoyancy perforating methods and apparatus.

2. Description of Related Art

Traditional petroleum drilling and production technology often includes procedures for perforating the wall of a production well bore into the fluid bearing strata to enhance a flow of formation fluid along perforation channels. Depending on the well completion equipment and method, it is necessary for such perforations to pierce a wellbore casing, a production pipe or a tube wall. In many cases, the casing or tube is secured to the formation structure by a cement sheath. In such cases, the cement sheath must also be pierced by the perforation channel as well.

There are three basic methods presently available to the industry for perforating wells. Those three methods are: a) explosive propelled projectiles, b) pressurized chemicals and c) shaped charge explosives. Generally, however, most wells are perforated with shaped charge explosives. Accordingly, the preferred embodiment description of the present invention will be directed to shaped charge perforators. However, many of the invention characteristics may be adapted to other perforation methods.

Shaped charge explosives are typically prepared for well perforation by securing a multiplicity of shaped charge units within the wall of a steel pipe section. The pipe section bearing the shaped charges may be supported from the wellhead at the end of a wireline, coiled tube, coupled pipe or drill string for location within the wellbore adjacent to the formation zone that is to be perforated by detonation of the shaped charges.

Collectively, a pipe section and the associated charge units will be characterized herein as a "charge carrier." One or more charge carriers may be coupled serially, end-to-end, to provide a unitized gun section. A "perforating gun" may include one or more gun sections that are joined by swivel joints. A perforation gun is merely one of many "bottom-hole assemblies" or bottom-hole tools the present invention is relevant to.

Each shaped charge unit in a charge carrier comprises a relatively small quantity of high energy explosive. Traditionally, this shaped charge unit is formed about an axis of revolution within a heavy steel case. One axial end of the shaped charge unit is concavely configured. The concave end-face of the charge is usually clad with a thin metallic liner. When detonated, the explosive energy of the decomposing charge is focused upon the metallic liner. The resulting pressure on the liner compressively transforms it into a high speed jet stream of liner material that ejects from the case substantially along the charge axis of revolution. This jet stream penetrates the well casing, the cement sheath and into the production formation.

A multiplicity of shaped charge units is usually distributed along the length of each charge carrier. Typically, the shaped charge units are oriented within the charge carrier to discharge along an axis that is radial of the carrier longitudinal axis. The distribution pattern of shaped charge units along the charge carrier length for a vertical well completion is typically helical. However, horizontal well completions may require a narrowly oriented perforation plane wherein all shaped charge units within a carrier section are oriented to discharge in substantially the same direction such as straight up, straight down or along some specific lateral plane in between. In these cases, selected sections of charge carriers that collectively comprise a perforation gun may be joined by swivel joints that permit individual rotation of a respective section about the longitudinal axis. Additionally, each charge carrier may be asymmetrically weighted, for example, to orient a predetermined rotational alignment when the gun system is horizontally positioned.

Controlled Buoyancy Perforating (CBP) allows the use of long perforating gun sections in horizontal and extended reach wells by reducing the weight and increasing the buoyancy of the perforating equipment. Reduction of the gun weight correspondingly reduces the bearing weight of the gun against the horizontal segments of the borehole wall and hence, the frictional forces opposing axial movement of the gun string along the well bore length. CBP objectives are accomplished by a combination of designs and materials such as composite material carrier tubes, caseless perforation charges and foamed material charge holders. Other inventions and innovations that pertain to Controlled Buoyancy Perforating (CBP) are described in U.S. Pat. No. 7,195,066 which is incorporated herein by reference.

Although the thrust of CBP is focused upon reductions of the gun weight, the requirements of internal seal integrity from an external fluid pressure environment and rapid assembly and disassembly on the rig floor remain the same as known to the prior art. Also imperative of CBP is a rig floor assembly system that confidently maintains a predetermined angular orientation of the perforation charges.

Prior art perforating guns are, generally, a serial assembly of charge carriers, end-to-end, in 30 ft. to 90 ft. segments. As the longitudinal axis of a charge carrier segment is suspended vertically from a derrick crown block, the lower end of the segment is aligned with the upper end of a tool string or preceding charge carrier segment that is suspended vertically within the well bore from the rig floor; usually by a slip accessory in the rotary drive table. A threaded end connector joins the adjacent ends of the axially aligned segments when either segment is rotated relative to the other about the longitudinal axis common to both.

Although threaded steel carrier connections as previously described are suitably strong for supporting the enormous weight of a steel perforating gun, the incremental assembly process is relatively slow. CBP technology greatly alleviates these joint loads on a gun assembly. Where a 5 in. conventional steel perforating gun may weigh in excess of 14 lb/ft., a similar, CBP composite material system may weigh only 4 lb/ft. A 5,000 ft. long perforating gun having a weight distribution of only 4 lb/ft. requires the upper end connectors to support a 20,000 lb air weight load. As a CBP gun is lowered into the well and the gun weight is supported by the displacement forces of the wellbore fluid, the tensile loads on the connectors and connector threads is negligible. However, after the gun is discharged, the gun buoyancy is dramatically reduced by the consequential flooding of the internal gun volume. Hence, even though CBP technology may reduce the stress demands on a charge carrier connection, significant strength requirements remain.

One of the driving objectives of CBP, therefore, is to place extremely long perforating guns in substantially horizontal production bores. Reduction or elimination of the rotational steps in the charge carrier assembly process could greatly accelerate the perforating gun assembly procedure.

It is an objective of this invention, therefore, to provide a bayonet joint connection between charge carrier joints that requires no rotation.

Another objective of this invention is a rapidly assembled bayonet connection between charge carrier joints that maintains a predetermined angular orientation between the joints.

Also an object of this invention is a steel connecting collar between non-metallic housing tubes for charge carrier joints.

A still further object of this invention is a method and apparatus for rapid preassembly of an inner loading tube within an outer carrier housing that requires no intermediate booster assembly.

BRIEF SUMMARY OF THE INVENTION

These and other objects of the invention as will emerge from the following Detailed Description are addressed by a perforating gun that is particularly suited for controlled buoyancy perforating. The perforating gun of the present invention comprises the end-to-end assembly of two or more charge carrier joints. Each joint comprises an inner loading tube that directly supports the shaped charge units and the cooperative detonation elements. For buoyancy contribution, the inner loading tube may be formed of a light weight material such as foamed plastic. However, at a chosen point along the length of the inner loading tube and around the loading tube circumference, a firm reference surface is secured to the loading tube structure.

The inner loading tube is nested coaxially within an outer housing tube, the internal volume of which is for environmental isolation from wellbore fluids and other contaminants. Also for controlled buoyancy contribution, the outer housing tube may be fabricated of high strength, non-metallic materials such as composites with glass or carbon fiber.

To support the stress concentrations at the union point between a pair of joint ends, a composite or other non-metallic housing tube may be terminated by metallic, i.e. steel, transition collars.

Near one end of a charge carrier joint, preferably combined with a transition collar, a reference surface is provided to accommodate the reference surface of the inner loading tube. The inner loading tube must have the required orientation about the housing axis for the two reference surfaces to correctly engage. Additionally, engagement of the two reference surfaces secures the relative position proximity between the two detonation boosters of a union between two charge carrier joints. As the joint union is angularly controlled, the respective carrier joint ends to a union are assembled, generally, with a bayonet motion sequence comprising rotational alignment, compressive translation (lapping) and latching.

In one embodiment of the invention, a charge carrier joint may comprise steel transition collars secured to opposite ends of a reinforced plastic or composite material housing tube. Angular orientation between the two collars of a union is maintained by alignment pins that bridge the union interface to penetrate prepositioned alignment bores or pin sockets. The union is environmentally sealed by a first set of O-rings between an internal sleeve and the internal bore of a transition collar. A second set of optional or redundant O-ring seals is provided between the external surface of the transition collar and the internal surface of a cylindrical connector sleeve.

The connector sleeve has an axially sliding fit around the outer perimeter of the transition collars. Collet fingers project longitudinally from each end of the connector sleeve and each finger has a barbed end for meshing with a detent channel around the perimeter of each collar. When two joints of a union are axially pressed together, e.g. "lapped", the collet finger barbs enter the respective detent channels to prevent opposite direction separation e.g. "latched". Preferably, a keeper ring that encompasses the circumference of the collet fingers is slidably translated over the finger ends when the barbs are meshed with the detent channel.

Selective separation may be accomplished by translating or cutting the keeper ring to remove the belting function around the collet fingers. A tool is used to lift and hold all of the barbs in a respective detent channel out of the channel until sufficient axial translation occurs to prevent return to the detent channel.

An annular seating plane is provided internally of each transition collar to receive an alignment collar secured to each inner loading tube. The inner loading tube is a unitizing element within a carrier joint for all of the shaped charges and shaped charge ignition means comprising the ignition fuse and detonation booster elements. A loading tube collar reference plane contiguously abuts the transition collar seating plane to operationally position the ignition means booster elements at each end of an inner loading tube. A threaded setting ring or resiliently biased snap-ring secures the tight engagement of the loading tube collar reference plane against the transition collar seating plane, An orientation pin or key secures the correct angular orientation of the inner loading tube with respect to the charge carrier axis.

BRIEF DESCRIPTION OF THE SEVERAL VIEWS OF THE DRAWINGS

The invention is hereafter described in detail and with reference to the drawings wherein like reference characters designate like or similar elements throughout the several figures and views that collectively comprise the drawings. Respective to each drawing figure.

DETAILED DESCRIPTION OF THE INVENTION

Figure 1:
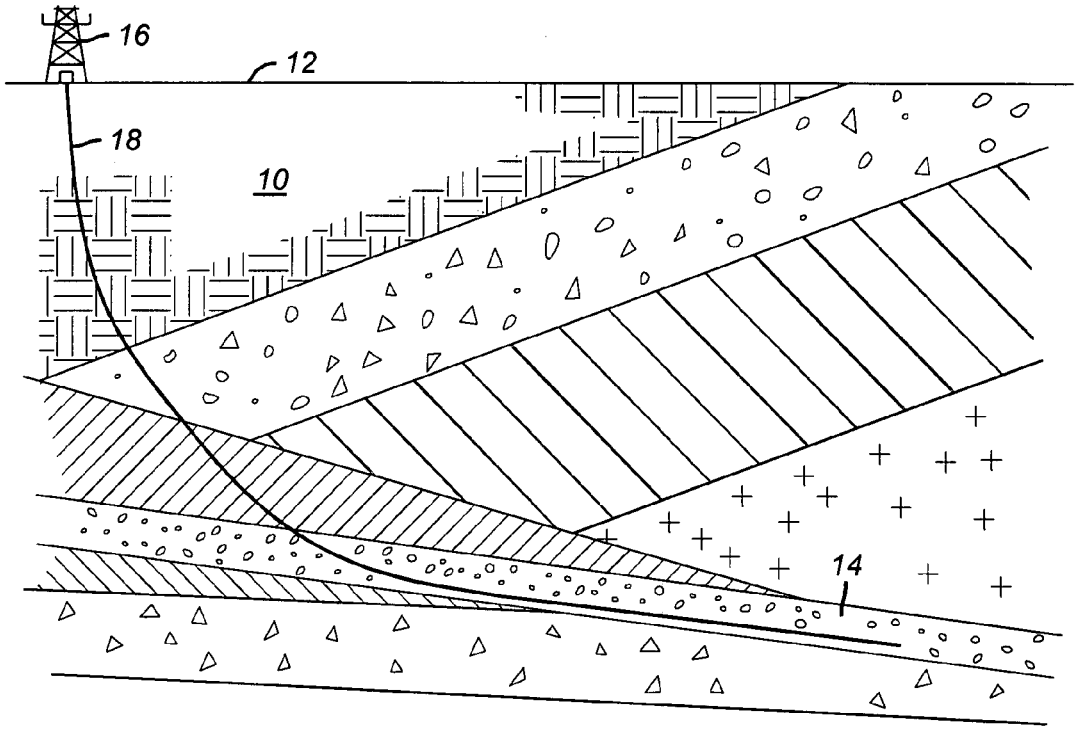
FIG. 1 is a schematic earth section illustrating a deviated wellbore having a substantially horizontal fluid bearing strata.

For environmental reference, FIG. 1 represents a cross-section of the earth 10. Below the earth surface 12, the earth firmament comprises a number of differentially structured layers or strata. For the present purposes, a thin and mildly sloped strata 14 is represented to be of particular interest due to an abundant presence of petroleum.

From a drilling/production platform 16 on the earth surface 12, an extended wellbore 18 is drilled into and along the strata 14. In this case, the wellbore 18 is drilled to follow the bottom plane of the strata.

There are many well completion systems. Although the present invention is relevant to all completion systems in one form or another, the "cased hole" completion represented by FIG. 2 serves as a suitable platform for describing the presently preferred embodiments of the invention.

Figure 2:
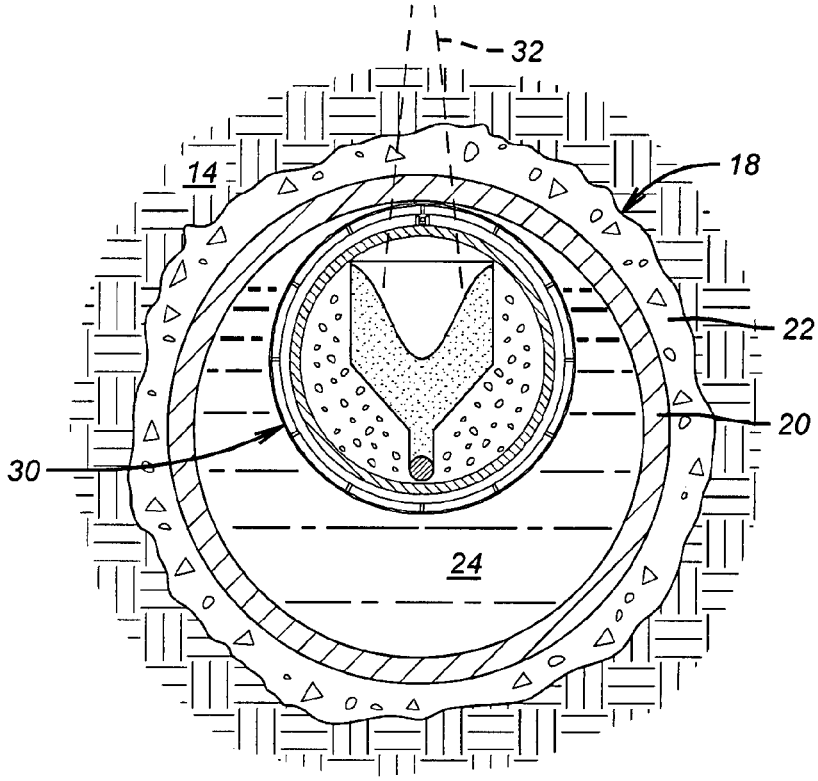
FIG. 2 is a is a wellbore cross-section as seen from the FIG. 1 cutting plane 2-2 illustrating the present invention perforating gun buoyed against the upper wall elements of the wellbore wall.

With respect to FIG. 2, the borehole 18 along the production strata 14 is lined by casing 20 set within a cement sheath 22. In the course of drilling and/or casing, the borehole 18 and ultimately, the casing 20, is flooded with fluid. Usually, the fluid is liquid and the liquid usually includes water. In some wells, however, the fluid is natural gas or oil. The presently described example of a preferred invention embodiment proceeds with the assumption of a liquid environment 24 within the well casing 20.

After the wellbore 18 is cased, the casing 20 and cement sheath 22 must be perforated to allow fluid production flow from the strata 14 into the casing interior and ultimately, into a production tube not shown. Typically, the casing, cement sheath and formation are perforated by a multiplicity of shaped charge jets as represented by the converging dashed lines 32 of FIG. 2. The mechanism of such perforations may be a perforation gun 30 according to the present description.

Typically, a perforating gun 30 is an assembly of several shaped charge carrier sections or joints. Coaxially aligned, adjacent charge carrier sections or joints may be joined end-to-end by connectors. Long perforating guns are normally assembled in "joint" increments of approximately 20 to 30 ft. length. In the parlance of the art, a "joint" of pipe is about 30 ft. long. A "stand" of pipe is normally about 90 ft. or three, pre-assembled "joints". The "stand" length is a function of the derrick height that is, nominally, 100 ft. When drilling, i.e. when the depth or length of the borehole is being increased, drill pipe is added to the drill string in lengths corresponding to the length of the square-sided Kelly pipe which is the drive link between the rotary table and the drill pipe string. Normally, a Kelly pipe length corresponds to the length of one drill pipe joint or, about 30 ft. When the drill string is withdrawn from the wellbore, and hence, returned, however, the rotary table is not engaged and the Kelly pipe is removed from the pipe string. Consequently, the pipe string may be assembled or disassembled more rapidly with individually handled pipe sections that are 90 ft. "stands" rather than as a 30 ft. "joint".

While the length of a charge carrier joint is not restricted to the length of a Kelly pipe, there are material handling practicalities to be observed in the rig floor assembly of a perforating gun that may be greater than a mile long. Hence, the length of a single, i.e. integral, charge carrier joint is often restricted to about 20 to 30 ft. A long perforating "gun", therefore, is the end-to-end connected assembly of numerous charge carrier "joints". The half-section of FIG. 3 represents the mutual assembly of two charge carrier joints 34 by a connector 40 into a unified perforating gun 30.

When oriented perforation is desired for a perforating gun string comprising numerous charge carrier sections, carrier section groups may be linked by swivel joints for relative rotation about a longitudinal tube axis to facilitate gravity orientation. However, positive indexing structure is necessary to maintain the required spatial and angular relationship between the several shaped charge joints within a section and the means or device that determines the vertical or horizontal plane for the section.

Figure 3:
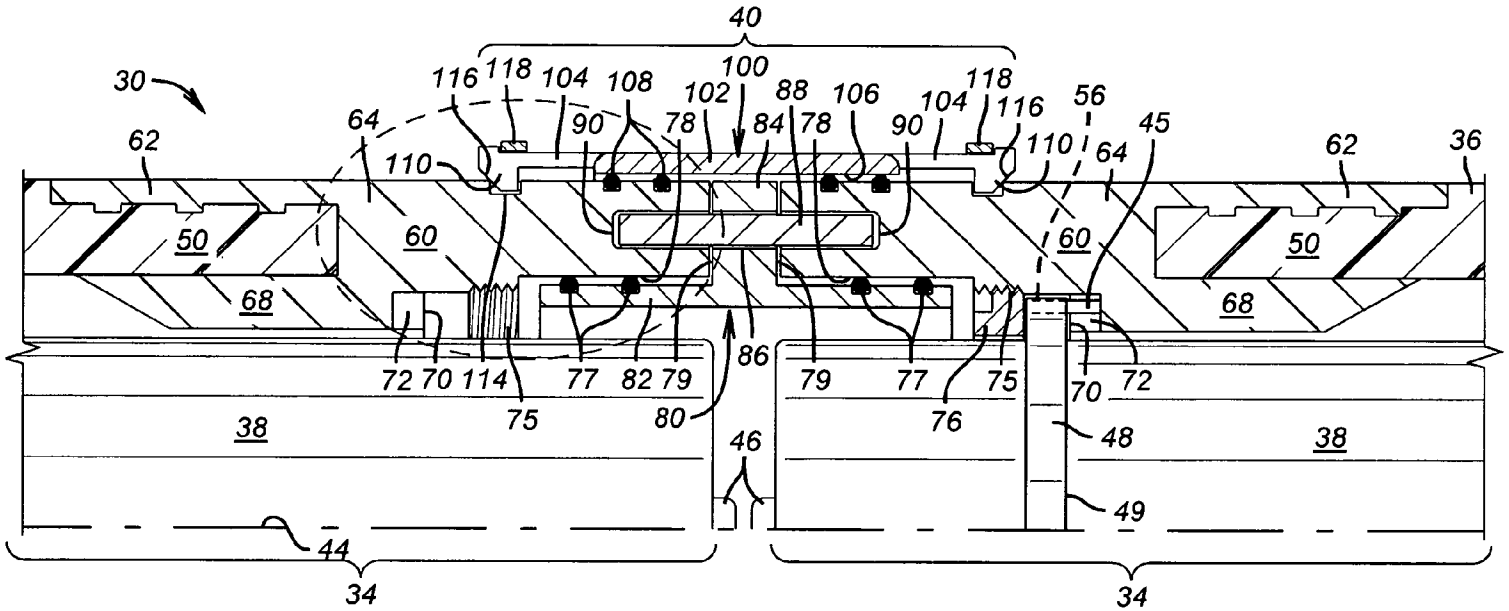
FIG. 3 is a half-section of a pair of charge carrier joints at the mutual end connection according to the invention.

Referring to FIGS. 2 and 3, charge carrier joints 34 respective to the present invention broadly comprise an outer carrier housing 36 and an inner loading tube 38. The outer carrier housing 36 is the exoskeleton of the assembly that carries the suspended weight stress and environmentally protects the explosive material within the inner loading tube 38 from destructive contamination by wellbore fluid. Adjacent ends of serially adjacent carrier joints 34 are preferably joined by a bayonet connector 40. Angular alignment means such as an index pin 88 secures a predetermined angular orientation of adjacent carrier joints 34 about the substantially common axis 44 relative to a common reference radian from the common axis.

The structurally independent inner loading tube 38 directly seats and confines the several shaped charges in a carrier joint 34 to the desired alignment relative to the reference radial from the longitudinal axis 44 of the loading tube. The inner loading tube 38 has an assembly interface with the connector mechanism to secure angular orientation of the loading tube 38 relative to the outer carrier housing 36. Additionally, the respective lengths of the inner loading tube 38 and the outer carrier housing 36 are coordinated and relatively confined longitudinally to assemble adjacent detonation boosters 46 respective to adjacently connected charge carrier joints 34 within ignition proximity simultaneously with a bayonet assembly of the outer carrier housings 36.

A preferred embodiment of an outer carrier housing 36 comprises a composite material tube 50 having metallic transition collars 60 for interfacing the composite material tube 50 with cooperative steel connectors 40. The composite housing tube 50 of FIG. 3 may comprise an oriented alignment of glass fiber, polyaramid, carbon or other fiber in a polymer bonded composition to create the desired buoyancy characteristics. The anticipated depth, pressure and temperature of the well often determines the fiber, the fiber orientation, the polymer and the wall thickness used for the housing tube 50 fabrication. At each end of a housing tube joint, connector meshing channels 52 are turned or molded into a reduced O.D. end-segment 54.

The transition collar embodiment 60 of FIGS. 3 through 10 comprises a metallic, usually a malleable steel, swaging skirt 62 extending from a body ring 64. As fabricated and before installation on the end of a housing tube 50, the swaging skirt 62 is conically flared about the collar axis 44. The inside face of the swaging skirt 62 is formed with circumferential ring lands 66 that are sized and spaced to mesh with the channels 52 in the end segment 54 of the housing tube 50. Also extending circumferentially from the base ring 64 and in generally coaxial alignment with the swaging skirt 62 is an inner mandrel ring 68.

Figure 8:
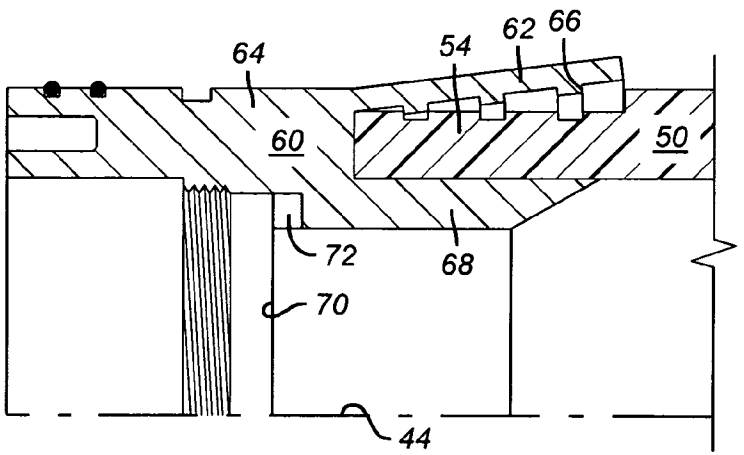
FIG. 8 is a half-section of an outer housing tube in partial combination with a cooperative transition collar.
Figure 9:
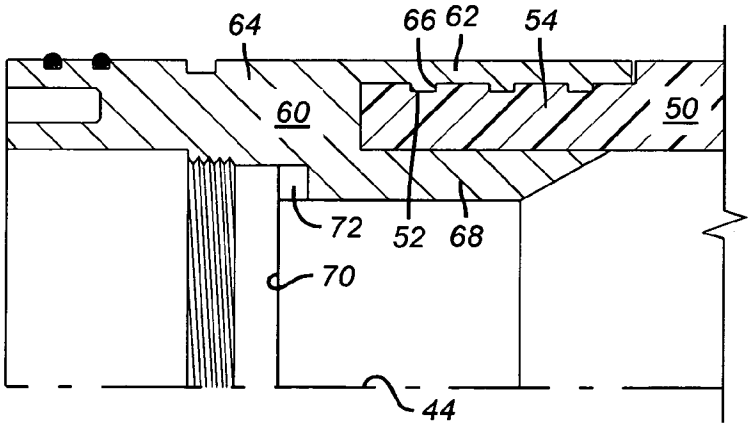
FIG. 9 is a half-section of an outer housing tube in full combination with a cooperative transition collar.
Figure 10:
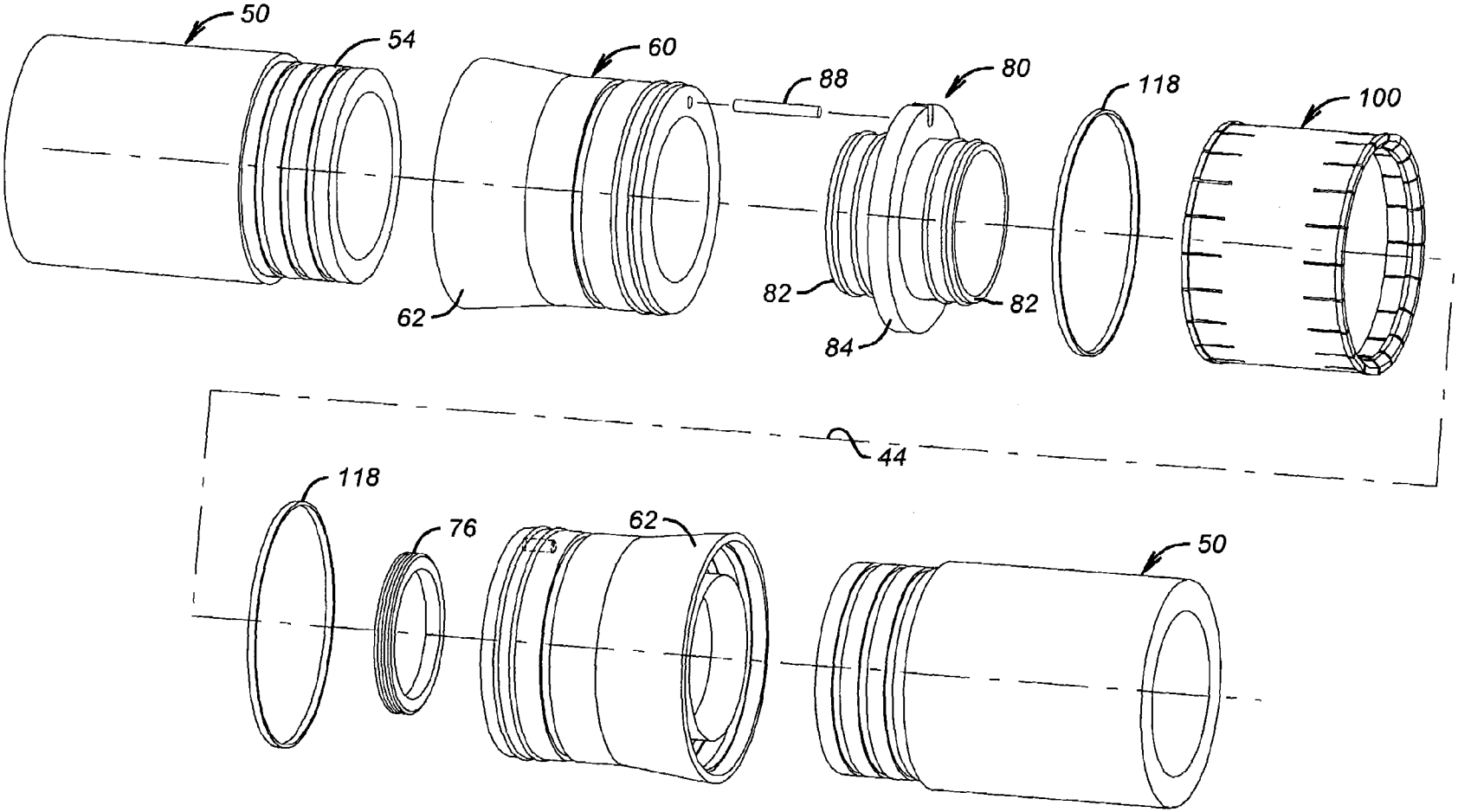
FIG. 10 is an axially exploded pictorial of the FIG. 3 embodiment illustrating the major independent components of the connection.

Assembly of the transition collar 60 with carrier housing tube 50 comprises deformation of the flared swaging skirt 62. With respect to a comparison between the swaging skirts 62 illustrated by FIGS. 7 through 9, respectively, it is seen that the flared skirt 62 of FIG. 7 has been deformed from the originally fabricated conical geometry into the cylindrical geometry of FIG. 9. This deformation compresses the composite material end-segment 54 of the housing tube 50 between the inner mandrel ring 68 and the outer swaging skirt 62. An intermediate moment in the deformation process (swaging) is shown by FIG. 8 as the conical base of the skirt 62 is compressed toward a cylindrical form. The ring lands 66 extended from the inside surface of the skirt 62 are meshed into the ring channels 52 in the housing tube 50 thereby securing the transitional collar 60 to the housing tube 50. For greater strength, the exterior surface of the housing tube end-segment 54 or the inside surface of the skirt 62 may be coated with a bonding polymer such as epoxy prior to the skirt swaging. Subsequent to swaging, the polymer is cured. Any stress analysis of this transition collar embodiment should also consider the "work hardening" contribution of swaging which normally tends to increase the collar tensile strength.

In this FIG. 3 embodiment of the invention, the transition collar body ring 64 further includes the surface of an interior ring ledge 70 that seats the inner loading tube 38 at a longitudinal reference position relative to the housing tube 50 length. An alignment collar 48 that is firmly secured to the loading tube 38 is clamped between the seating ledge 70 and a threaded seating ring 76 to secure the longitudinal position of the loading tube 38 relative to the axial length of the charge carrier. A key slot 72 in the seating ledge 70 accommodates a shear key 45 that also penetrates a key aperture 56 in the alignment collar 48. The key slot 72 is positioned as a reference radial to secure the loading tube 38 from axial rotation relative to the housing tube 50. Discharge orientation of the shaped charges that are set in the loading tube 38 is fixed, angularly, with respect to the key aperture 56.

The inside surface 78 of the transition collar 60 between the setting ring threads 75 and the collar end 79 is preferably smooth to accommodate O-ring seals 77 between the transition collar surface 78 and an internal sealing sleeve 82.

As an integral element of an internal sealing tube 80, the sealing sleeve 82 extends in opposite directions, axially, from an external spacing ring 84. The spacing ring 84 is either notched or bored with a dowel pin aperture 86 to accommodate traversal of an alignment pin 88 that penetrates the radial alignment bores 90 respective to the cooperatively connected transition collars 60.

Holding the ends of adjacent charge carrier joints 34 together, axially, is a connector sleeve 100 comprising a cylindrical mid-body portion 102 and integral collet fingers 104. The inside surface 106 of the mid-body may be relatively smooth to accommodate an axially sliding seal engagement with O-ring seals 108. A latching mechanism comprises terminal barbs 110 at the opposite distal ends of the collet fingers 104. The barbs 110 are formed with an abutment face that engages a cooperative side-wall face of a detent channel 114 formed about the outside perimeter of the transition collar 60. The distal end-face 116 of each barb 110 is preferably tapered to accommodate the wedge of a disassembly tool 92. When the resiliently biased collet fingers 104 have pushed all of the terminal barbs 110 into the detent channels 114 to the design depth, belts or keeper bands 118 may be translated axially along the outside surface of the collet fingers 104 from a retainer position around the cylindrical mid-body 102 to a keeper position around the distal ends of the collet fingers 104. When positioned around the collet finger ends, the keeper bands 118 prevent the resilient collet fingers from flexing to release the barbs 110 from engagement with the transition collars 60.

In a preferred embodiment of the invention as illustrated by FIG. 3, the assembly of a charge carrier joint 34 comprises a steel transition collar 60 secured to each end of a carbon fiber (for example) carrier housing tube 50. An inner loading tube 38 comprising the shaped charges is fabricated with an alignment collar 48. The alignment collar key aperture 56 is angularly oriented with respect to the discharge axis or plane of the shaped charges. Additionally, the seating plane 49 of the collar is located relative to the detonation boosters 46 with the precision required to place the detonation boosters 46 of adjacent carrier joints 34 within detonation proximity upon final assembly.

This positional alignment of the inner loading tube 38 is secured in the axial directions by a setting ring 76. The setting ring 76 is turned along the threads 75 for advancement against the alignment collar 48. Tight engagement of the setting ring 76 against the abutment collar 48 longitudinally confines the collar 48 between the setting ring 76 and the seating ledge 70 of the transition collar 60. The shear key 45 penetrates both, the key aperture 56 in the collar 48 and the key slot 72 in the ledge 70. This shear key 45 penetration secures the required angular orientation of the shaped charges in the inner loading tube 38 relative to the transition collar 60 and the alignment bore 90 in the collar.

Further preassembly of a charge carrier joint 34 may include insertion of one end of a sealing sleeve 82 into the seal bore 78 of the one transition collar 60 respective to each charge carrier joint 34. The alignment pin 88 may be inserted through the spacing ring 84 aperture 86 and into the collar 60 aperture 90. With one keeper band 118 shifted axially over the connector sleeve mid-body 102, the respective collet fingers 104 may flex radially to allow a bayonet penetration of a transition collar 60 respective to a cooperative charge carrier joint 34 between the connector sleeve 100 and the internal sealing tube 80.

Description of a representative rig floor assembly of a perforating gun may begin with a first charge carrier joint 34 suspended within the well casing from retainer slips. Although either end of a charge carrier joint may be held above the slip plane of the rig floor, it will be assumed for this description that the "first" joint is suspended in the wellbore with only the "upper" end transition collar 60 above the rig floor slip plane and the remainder of the first joint below the slip plane. The "upper" end of the first joint also includes the preassembled sealing tube 80 and the connector tube 100. It is further assumed that the keeper band 118 for the "lower" collet fingers 104 has been translated over the respective collet finger barbs 110 to secure barb penetration into the detent channel 114. The keeper band 118 for the "upper" collet fingers 104 has been translated over the sleeve mid-body 102. Consequently, the "upper" collet fingers 104 are free to flex radially and receive a bayonet penetration of a transition collar 60 respective to a "second" charge carrier joint 34.

A "second" charge carrier joint 34 is added to the first by suspending the second joint in axial alignment with the first. On a rig floor, one end of the "second" charge carrier joint is secured to the rig elevator block and lifted to a point that places the other or "lower" end of the suspended "second" carrier joint axially above the "upper" end of the first joint. The adjacent "lower" end of the second joint includes no sealing tube 80 or connector sleeve 100. This second charge carrier joint 34 is rotationally oriented, (preferably manually) to align the pin 88 that is projecting from the first carrier joint 34 with the bore 90 of the second charge carrier joint 34. When the pin 88 is aligned with the bore 90, the second charge carrier joint is lowered against the first to close the ends together by a simple axial translation (lapping).

When the closure is sufficient, the "upper" collet finger barbs 110 on the first joint connector sleeve 100 will penetrate the detent channel 114 of the second carrier joint to latch the two carrier joints together. With the barbs 110 in the detent channel 114, the respective keeper band 118 may be axially translated from the mid-body portion of connector sleeve 100 to a position near the distal ends of the collet fingers 104 thereby preventing the barbs 110 from flexing out of the detent channel 114. The assembly procedure of this and the foregoing paragraphs defines a basic "bayonet" joint connection or assembly. More fundamentally, the bayonet mechanism usually includes (1) rotational alignment of the two joint components about an assembly axis; (2) a linear compressive lapping of the two joint components along the assembly axis; and (3) a spring biased latching of the joint components at the desired lap position.

Extraction of a gun from the borehole normally occurs after the shaped charges have been discharged and the tool is inert. There are occasions, however, that an armed and ready gun must be extracted. In any case, gun extraction generally requires the shaped charge carriers to be separated at the connector union. Consequently, it is highly desirable for the connector union between shaped charge carrier joints to be released quickly and without undue heat or shock.

Figure 6:
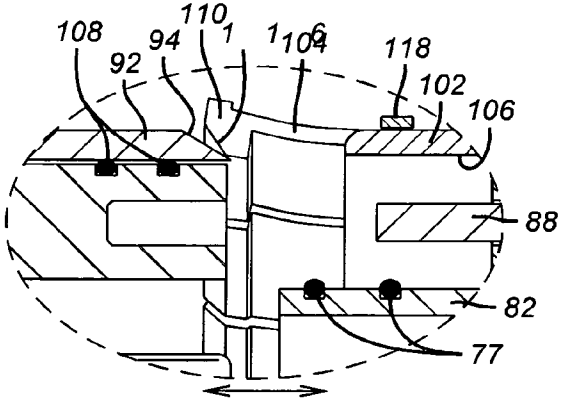
FIG. 6 is a detail section of the FIG. 3 joint connection showing an axial separation of a joint connection.
Figure 5:
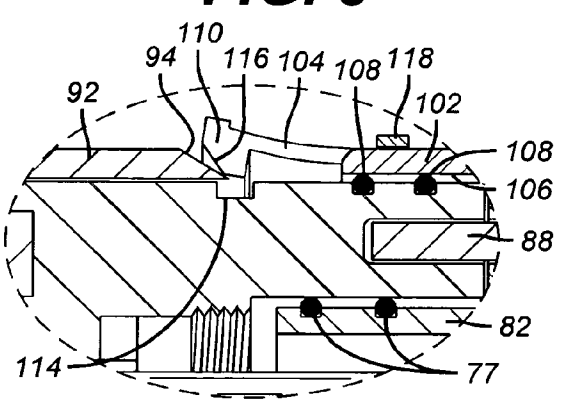
FIG. 5 is a detail section of the FIG. 3 joint connection showing a connector release.
Figure 4:
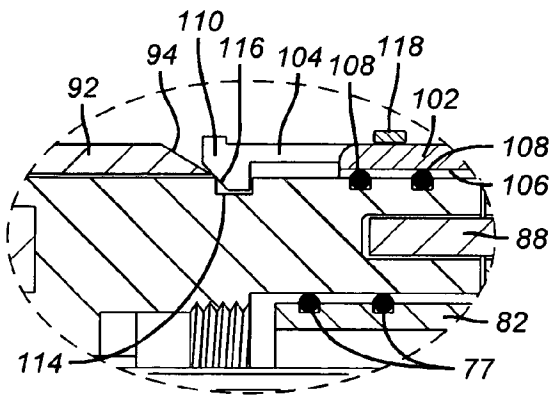
FIG. 4 is a detail section of the FIG. 3 joint connection showing initial placement of a disassembly tool.
Figure 7:
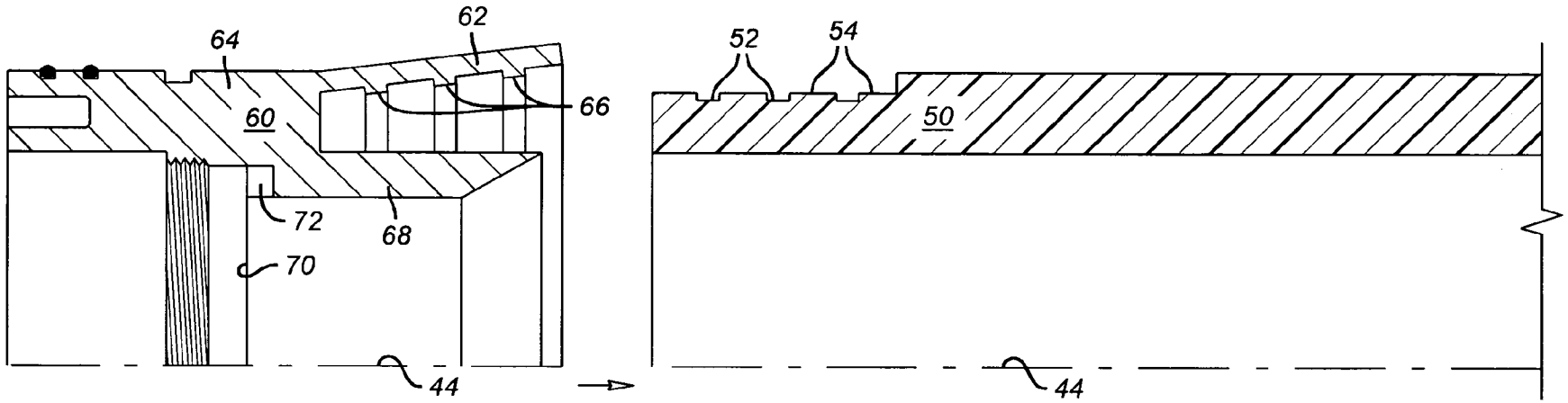
FIG. 7 is an expanded half-section of an outer housing tube and an un-attached transition collar.

For the FIG. 3 invention embodiment, the connector release sequence is illustrated by FIGS. 4 through 6. A unit of the gun assembly, whether as a single carrier joint or as a multiple joint stand, is lifted out of the wellbore by the derrick draw-works. As the selected unit is supported by the derrick, slips are set to support the gun portion remaining in the wellbore below the selected unit. The connection of adjacent transition collars 60 between the selected unit supported by the derrick and the gun portion suspended below the slips is thereby relieved of tensile stress. The keeper band 118 respective to the set of collet finger barbs 110 to be extracted from their detent channel 114 is either cut or translated axially over the connector mid-body 102 as illustrated by FIG. 4. With the keeper band 118 removed, the respective collet fingers 104 are free to flex away from the adjacent collar surface. A disassembly tool 92 having a tapered leading edge 94 may be positioned against the body ring 64 of one such transition collar 60 and forced against the tapered end-face 116 of a collet finger. As the leading edge 94 of the disassembly tool 92 advances, as shown by FIG. 5, the collet barb 110 is lifted out of the detent channel 114. When all of the barbs 110 on the connector sleeve 100 are lifted clear of the detent channel 114, the gun unit supported by the derrick draw-works may be lifted clear of the gun portion remaining in the wellbore suspended from the rig floor slips as represented by FIG. 6.

To lift all of the collet barbs 110 from the detent channel 114 simultaneously, the disassembly tool blade 92 may take the general form of a cylindrical annulus such as a section of pipe having an internal diameter slightly larger than the external diameter of the collar body ring 64. The cylindrical wall of the disassembly tool 92 may be split longitudinally along diametrically opposite lines and the two-half cylinders joined by a hinge along one of the split lines. This hinged connection of the two half-cylinders allows the tool 92 to be opened for positioning against the collar 60 and closed to embrace the full circumference of the collar and to thereby engage all of the collet finger barbs 110 simultaneously.

Figure 11:
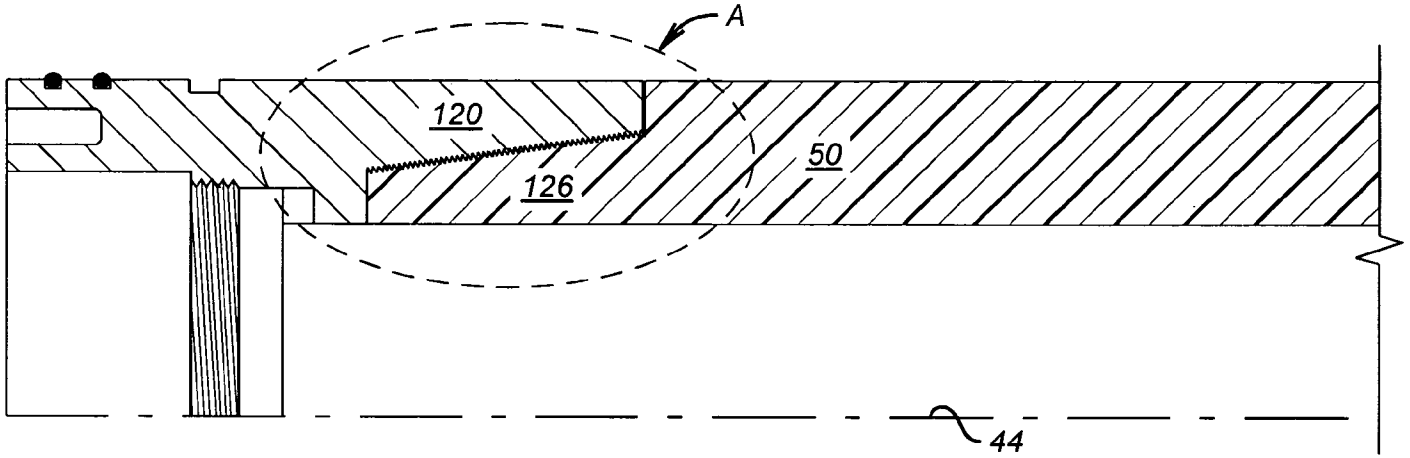
FIG. 11 is a half-section view of an alternative embodiment of the connection between the transition collar and the outer housing tube.
Figure 12:
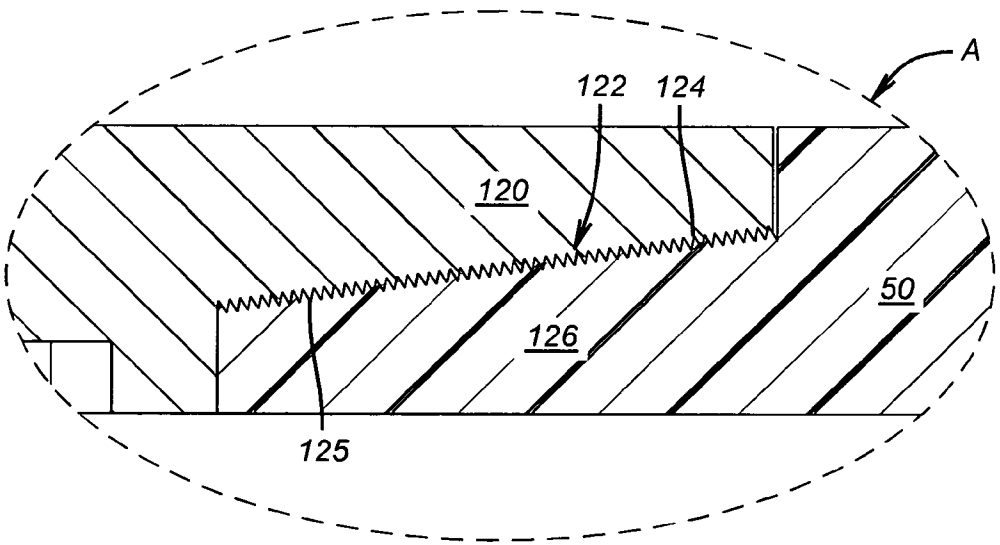
FIG. 12 is a detail section of the FIG. 11 area enclosed by the dashed line XII.

The transition collar embodiment of FIGS. 11 and 12 is similar to that of the FIG. 3 embodiment except for the swaging skirt interface. This FIG. 11 embodiment provides an interface skirt 120 having a belled or tapered inside surface 122 faced with a fine, (24 threads/in. for example), female thread 124. The mating end segment 126 of a housing tube 50 may be formed with a correspondingly tapered, external or male thread 125. It is not essential for the respective thread faces to mesh. The primary bonding mechanism of the threads is to increase the contiguous surface area of the mating elements. The thread face 124 of the collar skirt 120 is turned onto or pressed against the threaded end of the housing tube with a coating of uncured epoxy, for example, in between. Preferably, the interface is held under compressive pressure as the boundary film of epoxy between the adjacent threads is cured.

Figure 13:
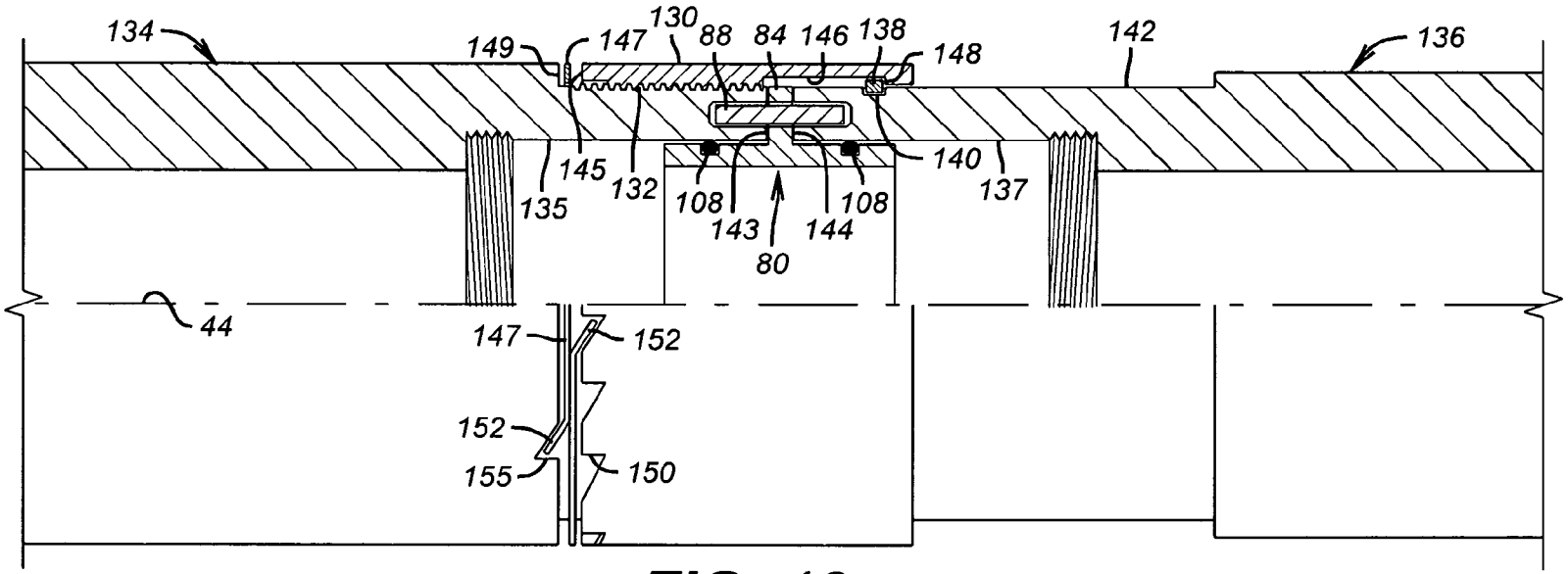
FIG. 13 is a half-section of a pair of charge carriers joined by a second connector embodiment.
Figure 14:
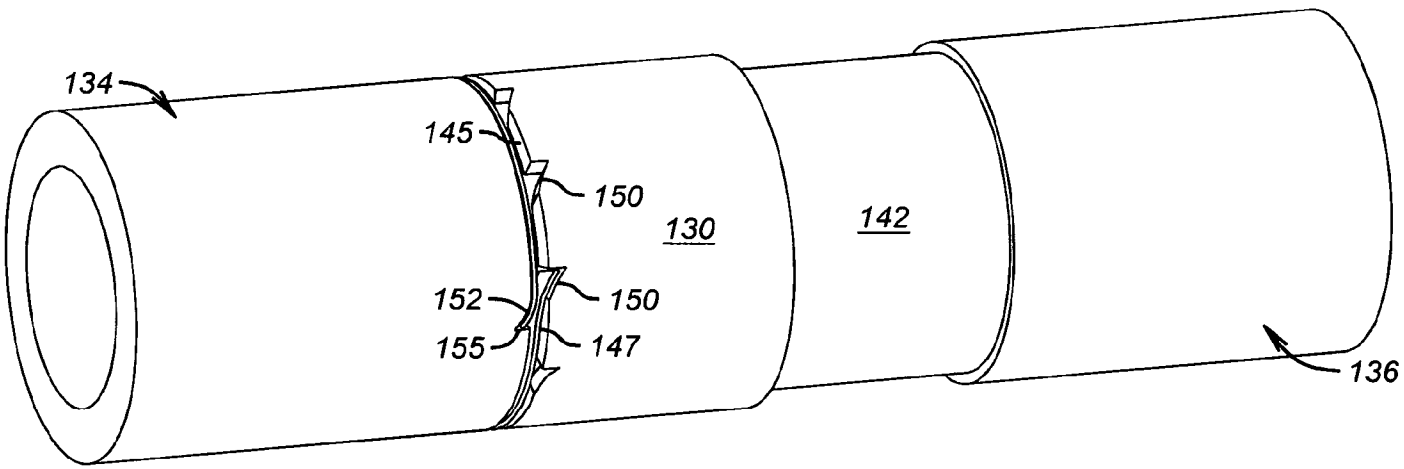
FIG. 14 is a pictorial view of the FIG. 13 connector embodiment.
Figure 15:
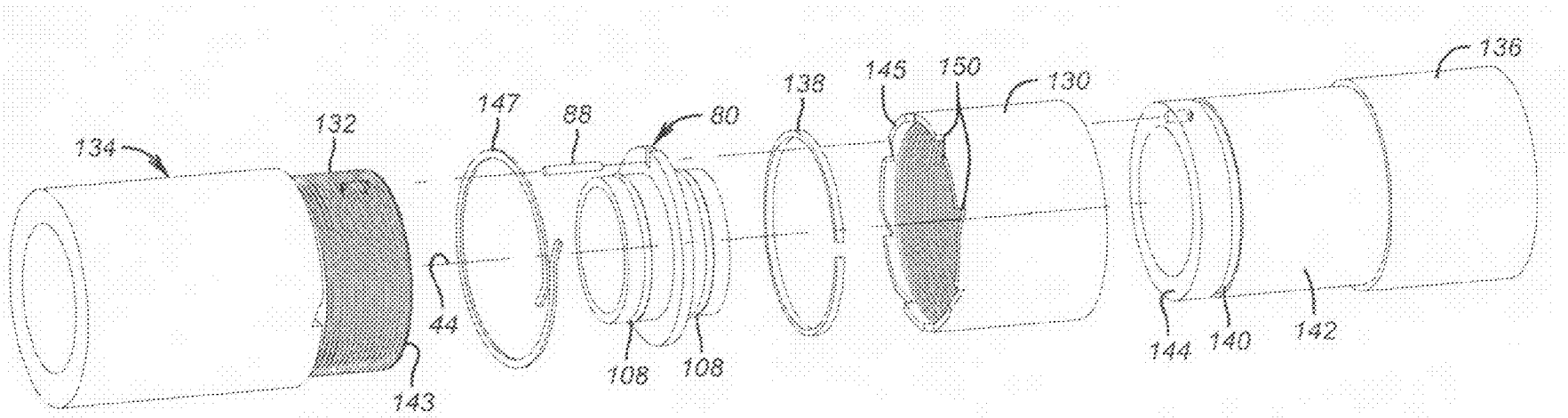
FIG. 15 is an axially exploded pictorial of the FIG. 13 embodiment.

The carrier joint connector embodiment of FIGS. 13, 14 and 15 comprises many characteristics of the FIG. 3 embodiment. A particularly notable difference, however, is that the transition collar at one end of a charge carrier joint differs from the transition collar at the opposite end of the same charge carrier joint. Another notable difference is that some rotational drive of a threaded connector sleeve 130 is required to complete the joint assembly.

Referring to FIGS. 13 and 15, the collar 134 is distinguished by a threaded interface 132 between a connector sleeve 130 and a transition collar body 134. The mating transition collar, 136, provides a circumferential snap ring 138 seated in a circumferential slot 140. A portion of the snap ring 138 annulus projects radially beyond the reduced diameter surface 142 of the collar 136 body to provide a load supporting ledge.

The internal cylinder bore 146 of connector sleeve 130 is under-cut between the internal thread 132 and an annular bearing face 148 at the distal end of the sleeve 130. The I.D. crest of the sleeve threads 132 is greater than the O.D. of the slot engaged snap ring 138 whereby the sleeve may be translated axially along transition collar 136 by passing the internal threads 132 of the sleeve 130 over the O.D. of the snap ring 138. With the connector sleeve 130 surrounding the collar 136 but displaced along the reduced diameter body surface 142 to expose the slot 140, the snap ring 138 may be positioned in the slot 140. Translation of the sleeve 130 in the opposite direction toward the end of the collar 136 is thereby restricted by an interference engagement of the sleeve bearing face 148 with the projecting annulus of the snap ring 138.

Both collars 134 and 136 have smooth inside bores 135 and 137 to accommodate the O-ring seals 108 of an internal sealing tube 80. As described with respect to the FIG. 3 embodiment, the two collars are rotationally oriented by an alignment pin 88.

Figure 15A:
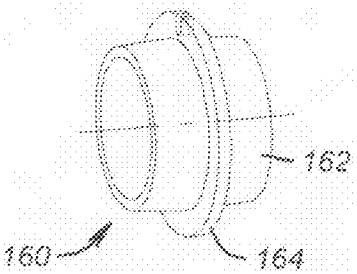
FIG. 15A is a pictorial view of an alternative embodiment of a tapered fit internal sealing tube.
Figure 16:
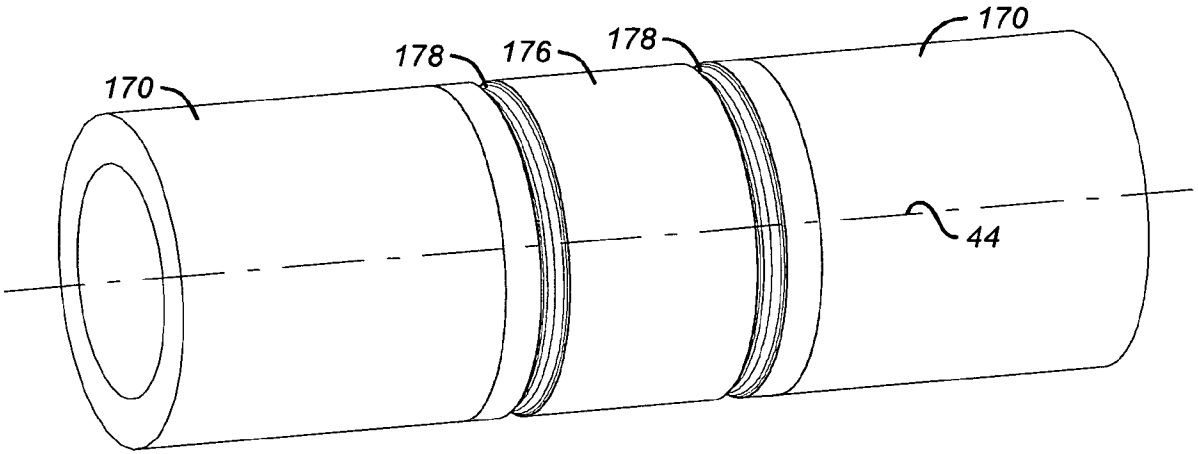
FIG. 16 is a pictorial view of a third embodiment of the invention.

FIG. 15A represents an alternative embodiment 160 of an internal sealing tube which includes an integral construction of the sealing sleeve 162 with the spacing ring 164. In lieu of O-ring seals, however, the outside surfaces of the oppositely extended sealing sleeve 162 are tapered to be compressed to an interference seal against the inside edge of the respective collar end-faces 143 and 144.

When a pair of transition collars 134 and 136 as shown by FIG. 15 are to be mated for assembly, the sleeve 130 has preferably been previously secured to the collar 136 by the snap ring 138. When the two collar ends, 134 and 136, are axially and angularly aligned, the sleeve 130 is translated along the reduced diameter body 142 of the collar 136 and rotated to mesh the threaded interface 132 with collar 134. The thread 132 engagement length and other dimensions of the assembly are coordinated to translate compressive engagement of the sleeve bearing face 148 against the snap ring 138 to a compression of the spacing ring 84 between the collar end-faces 143 and 144.

As best illustrated by FIG. 13, the collar end-faces 143 and 144 clamp against the sealing tube ring 84, the end-face 145 of the sleeve 130 compresses a lock ring or washer 147 against a thread root shoulder 149 on the collar 134. Notches 150 in the sleeve end-face 145 and notches 155 in the thread root shoulder 149 cooperate with lock ring tabs 152 to oppose any tendency of the sleeve 130 to rotate against the assembly under operational stress.

Disassembly of this FIG. 13 embodiment is enabled by either bending the lock ring tabs 152 out of the notches 150 or 155 or by cutting the lock ring 147. This procedure permits the sleeve 130 to be rotated over the threads 132 until free for translation away from the threaded collar 134. The sleeve 130, nevertheless remains captured around the transition collar 136 by the snap ring 138.

Figure 17:
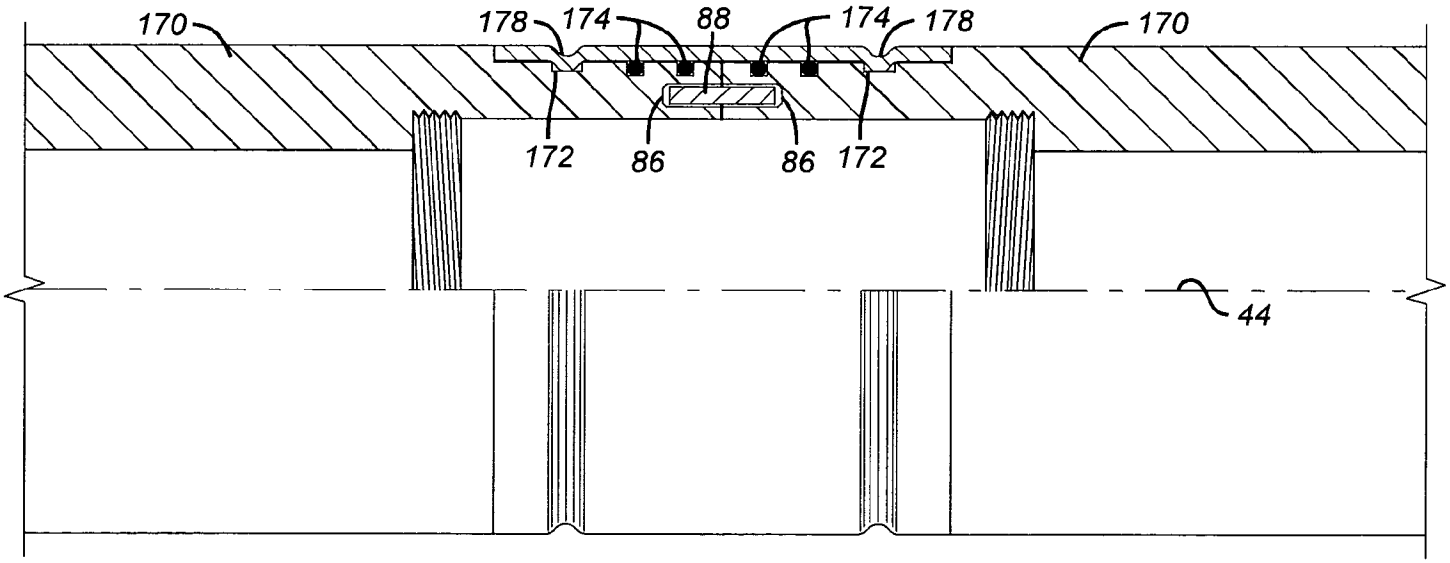
FIG. 17 is a half-section view of the third invention embodiment.
Figure 18:
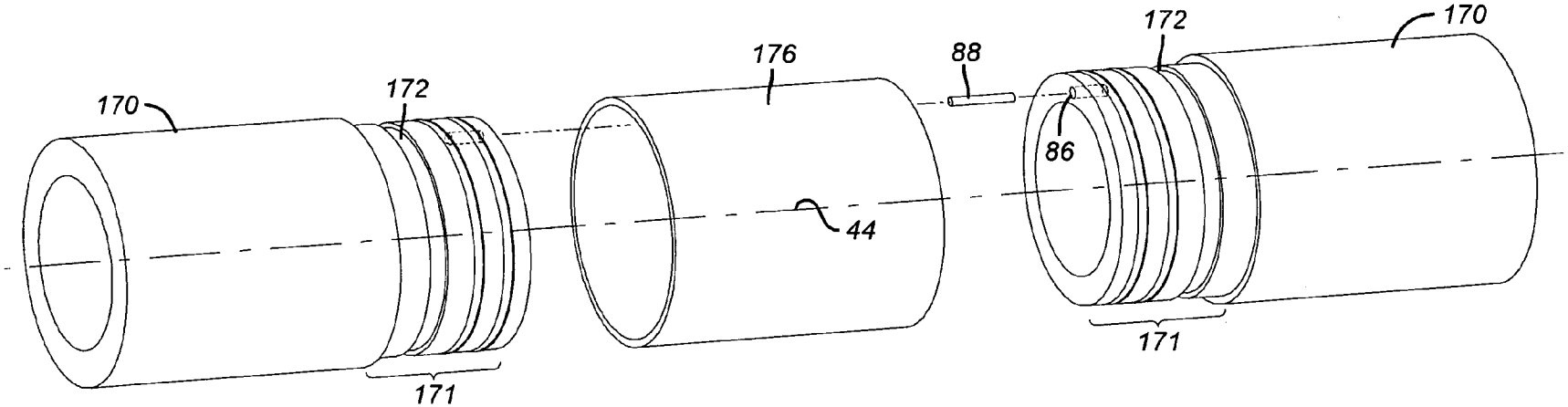
FIG. 18 is an axially exploded pictorial view of the third embodiment.
Figure 19:
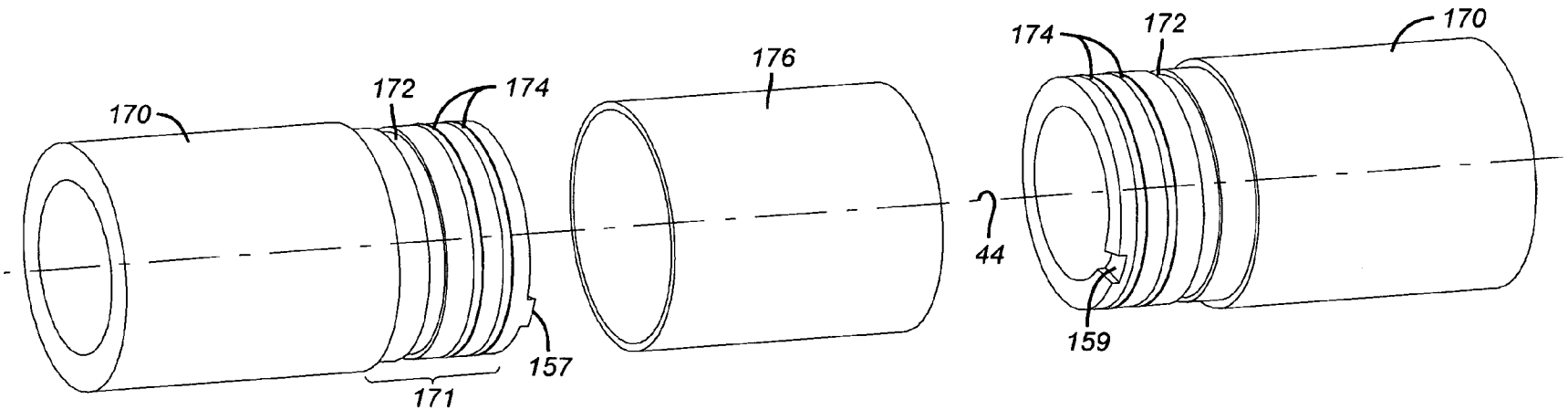
FIG. 19 is an axially exploded pictorial view of a modification of the third embodiment.

Another embodiment of the invention may take the form illustrated by FIGS. 16 through 19. In this embodiment, the transition collars 170 are identical for both ends of a carrier housing joint. Within a reduced outside diameter end portion (FIGS. 18 and 19), each collar 170 includes one or more external O-ring seals 174 positioned between the respective collar end-face and a detent channel 172. Angular orientation between two joining collars 170 may be achieved by one or more alignment pins 88 that penetrate respective apertures 86 in the collar end-faces as illustrated by FIGS. 17 and 18. Alternatively, the two collars 170 may also be angularly oriented in the manner illustrated by FIG. 19 which relies upon a perimeter key 157 projecting from the end-face of one collar 170 to mesh with a perimeter slot 159 in the cooperative collar end-face. Notably, this perimeter key and slot means for angularly orienting the FIG. 19 invention embodiment may be applied equally well to the embodiments of FIGS. 3, 13, 20 and 25.

The union of the two collar 170 end-faces is secured by a connector sleeve 176. The embodiment illustrated by FIGS. 16 through 19 illustrates collars 170 as having a slip fit assembly relationship over the reduced outside diameter end portion 171 of the collars. It will be understood, by those of skill in the art that the reduced diameter end-portion of a connector merely allows a reduced outside diameter for the sleeve 176. The invention embodiment may also be effectively practiced with no reduced diameter on the collar end portions and the connector sleeve 176 having an inside diameter greater than the outside diameter of collars 170.

The connector sleeve 176 length is selected to span axially past both detent channels 172 when the collar end-faces are abutting. A roll swaging tool, not shown, is used to press, e.g. swage, a channel bead 178 of the sleeve material into the respective detent channels 172. Preferably, a sleeve 176 is preassembled with one collar of a carrier joint prior to rig floor assembly. Consequently, when a rig floor connection is made, one channel bead 178 has already been swaged. On the rig floor, therefore, it is necessary, only to rotationally align the joints and function a swaging tool for the other channel bead 178.

Separation of the union between two charge carrier joints 34 joined by a swaged sleeve 176 may, for example, be quickly accomplished by a traditional pipe cutting tool, not shown. Since the sleeve 176 has a simple and inexpensively fabricated configuration, consumptive destruction of the sleeve 176 usually is an acceptable assembly expense.

Figure 22:
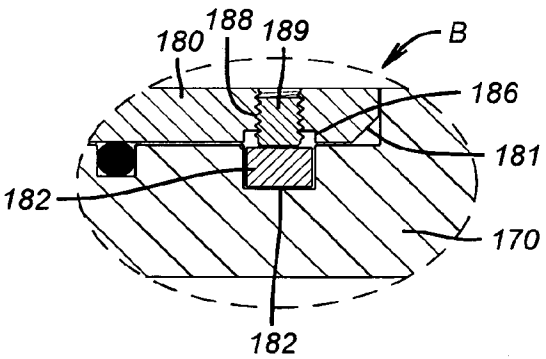
FIG. 22 is a detail section of the FIG. 20 area enclosed by the dashed line XXII.
Figure 21:
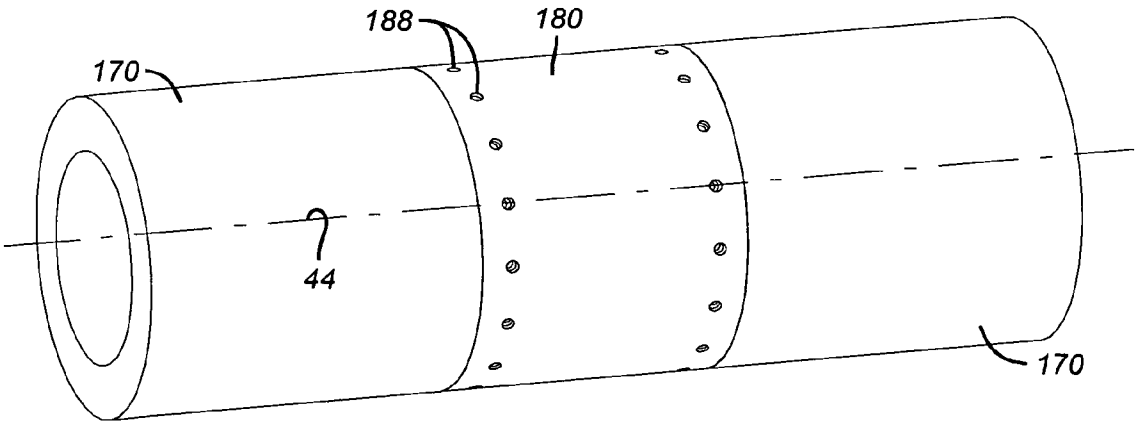
FIG. 21 is a pictorial view of the fourth invention embodiment.
Figure 23:
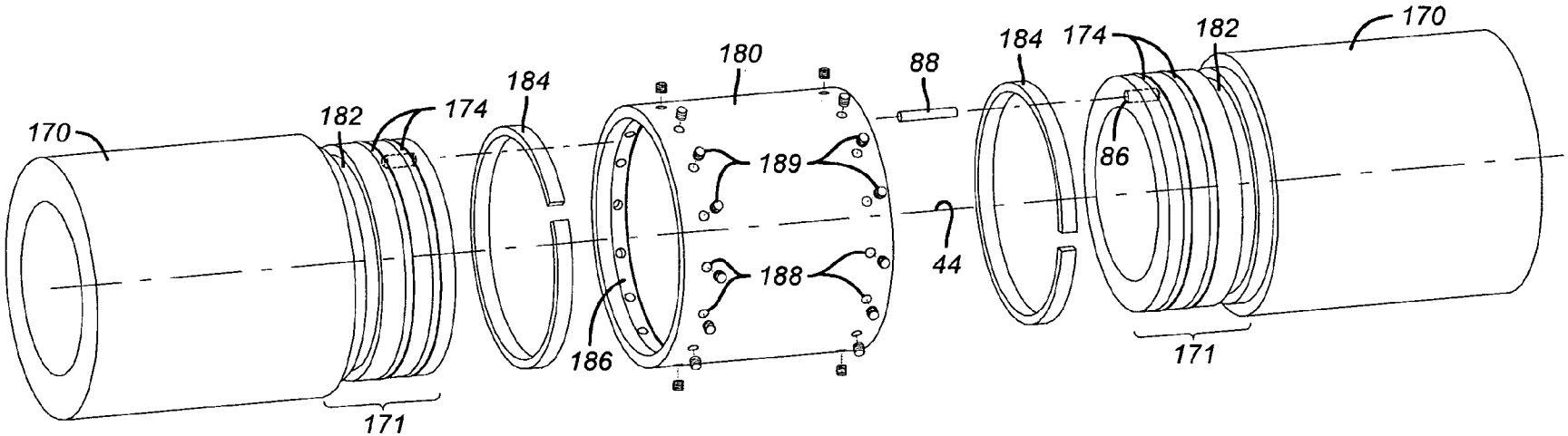
FIG. 23 is an axially exploded pictorial view of the fourth invention embodiment.
Figure 24:
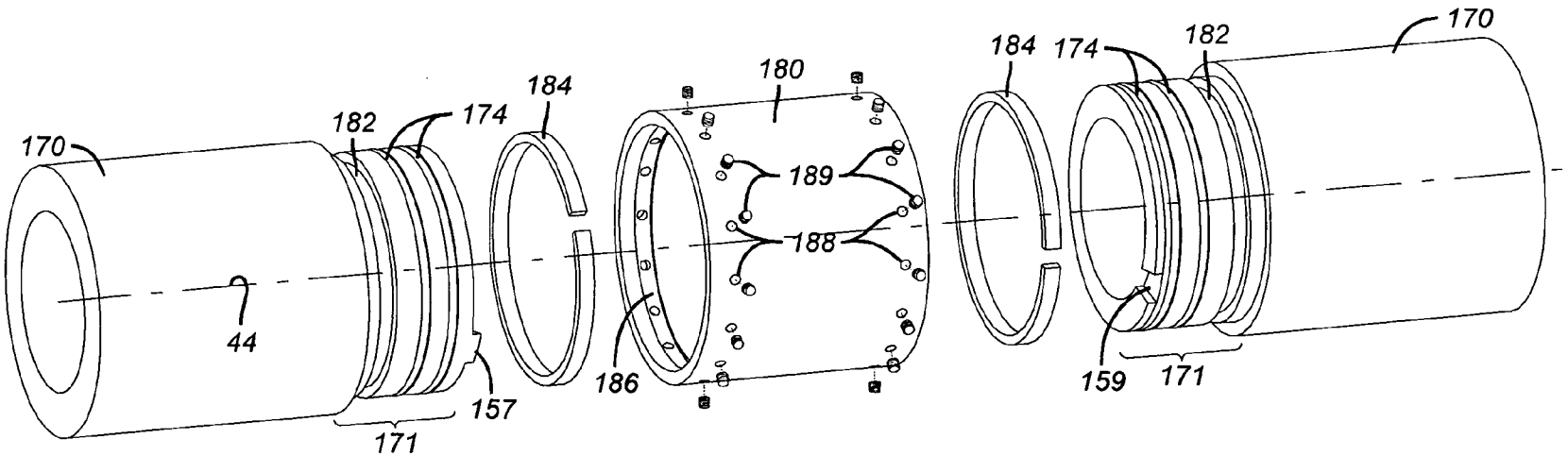
FIG. 24 is an axially exploded pictorial view of a modification of the fourth invention embodiment.

Another configuration of the invention, similar to that of FIGS. 16 through 19, may take the form of that illustrated by FIGS. 20 through 24. Transition collars 170 are substantially identical for both ends of the charge carrier joint. Angular orientation about the axis 44 may be secured by either alignment pins 88 (FIGS. 20 and 23) or a perimeter key 157 and slot 159 (FIG. 24). Along the length of the reduced diameter end portion of the collar 170, a retaining ring slot 182 is cut into the outside diameter surface to accommodate the full volume of a retaining ring 184.

The connector sleeve 180 for this FIG. 20 through 24 embodiment includes ring retention channels 186 around the inside perimeter in longitudinally spaced alignment with the snap ring channels 182 when the two transition collars 170 of a union have abutting end-faces.

The snap rings 184 are partial circles of resilient steel, for example, having an incomplete circular perimeter at a neutral, unstressed diameter. The neutral or unstressed outside diameter of the snap rings 184 generally corresponds to the root or greatest diameter of the retention channels 186 in the sleeve 180. The root or least diameter of the snap ring channels 182 corresponds to the inside diameter of a snap ring 184 when stressed to close a perimeter gap. When the perimeter gap is closed, the outside diameter of the ring 184 is equal to or less than the outside diameter of the collar end portion 171 as shown by FIGS. 22-24. The volumetric capacity of a snap ring channel 182 is sufficient to accommodate the entire volume of the ring 184 whereby the outside diameter elements of the snap ring 184 are radially at or below the outside diameter surface elements of the collar end portion when the ring is collapsed.

In radial plane alignment with the ring retention channel 186, a plurality of threaded apertures 188 are bored to penetrate the connector sleeve wall between the outside perimeter surface and the root diameter surface of the ring retention channel 186. As shown by FIG. 22, these threaded apertures 188 may be provided with set screws 189 as means for substantially displacing the snap ring 184 annulus from one of the detent channels 182 or 186 to release the sleeve 180 from the adjacent collar 170. These threaded apertures 188 are, axially, outside of the fluid sealed space between the inside surface of the sleeve 180 and the outside surface of the collar end portion 171 formed by fluid sealing means such as O-rings 174.

Figure 20:
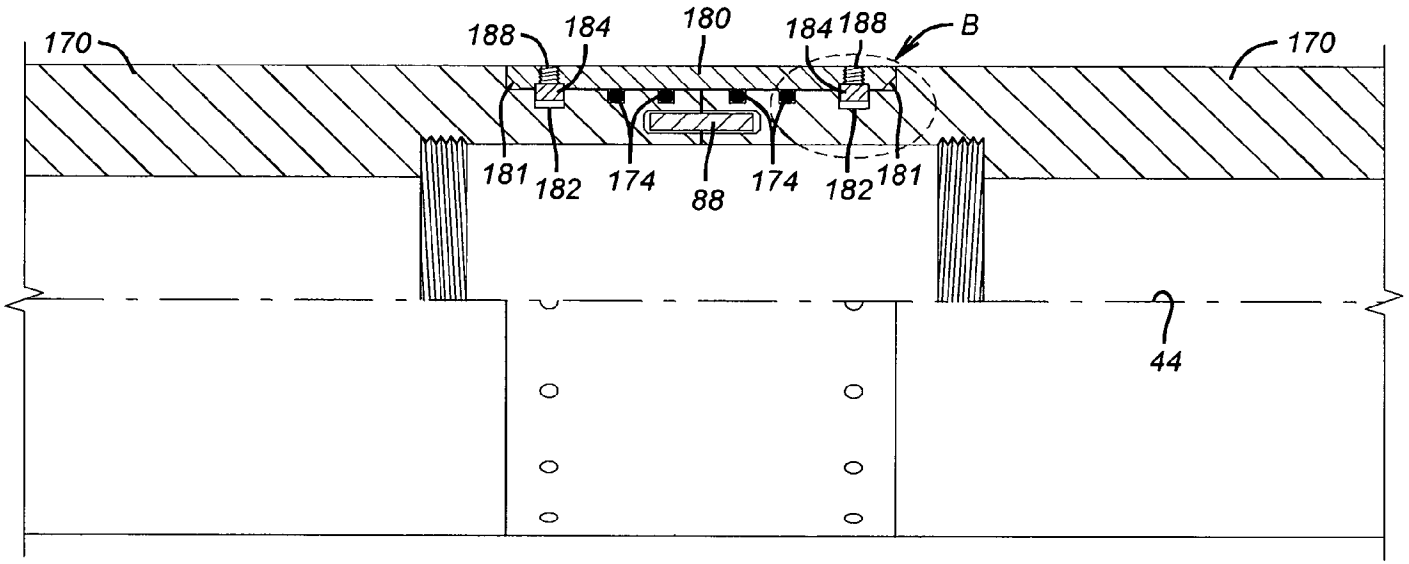
FIG. 20 is a half-section view of a fourth embodiment of the invention.

Placement of the snap rings 184 in the ring channels 182 is a preassembly function. When a secure union between abutting collars 170 is required, the set screws 189 are removed from the volumetric space of the retention channel 186. Moreover, it is preferable to have no set screws in the apertures 188 during the assembly process. When angularly aligned to permit collar end face abutment, upon compressive assembly force the ramped end faces 181 of the connector sleeve 180 will radially collapse the rings 184 into the volumetric space of channels 182 until there is an alignment with the sleeve retention channels 186. When radially aligned, the resilient bias of a ring 184 enlarges the ring diameter into the volume of a respective retention channel 186. The ring 184 expansion, however, is only sufficient to bridge the interface between the outside diameter of the collar 170 and the inside diameter of the sleeve 180 as illustrated by FIG. 20. The neutral or unstressed volume of the ring 184 penetrates a portion of the volumetric space of both channels, 182 and 186. The ring must therefore be sheared for further axial translation between the sleeve 180 and a collar 170.

Disassembly of a union is accomplished by installing and turning the set screws 189 inwardly against the snap ring 184 to collapse it against the root diameter surface of the channel 182 as shown by FIG. 22. A small, axial disassembly force against the respective collars 170 will overcome the frictional interface between the set screws 189 and the snap ring 184 to permit and axial disassembly translation between the two.

Those of skill in the art will understand that the set screw disassembly procedure described above merely represents one mechanical procedure for collapsing the internal snap ring 184. In lieu of set screws, the snap ring 184 may also be collapsed by a portable tool not illustrated that provides a radially oriented circle of hydraulically driven needle punches to penetrate the apertures 188. Although the drawings illustrate a multiplicity of set screws 189 around the connector sleeve 180 perimeter, it will be understood that only two or three set screws 189 or needle punches may be effective to sufficiently compress the snap ring 184 for disassembly of the union.

Figure 25:
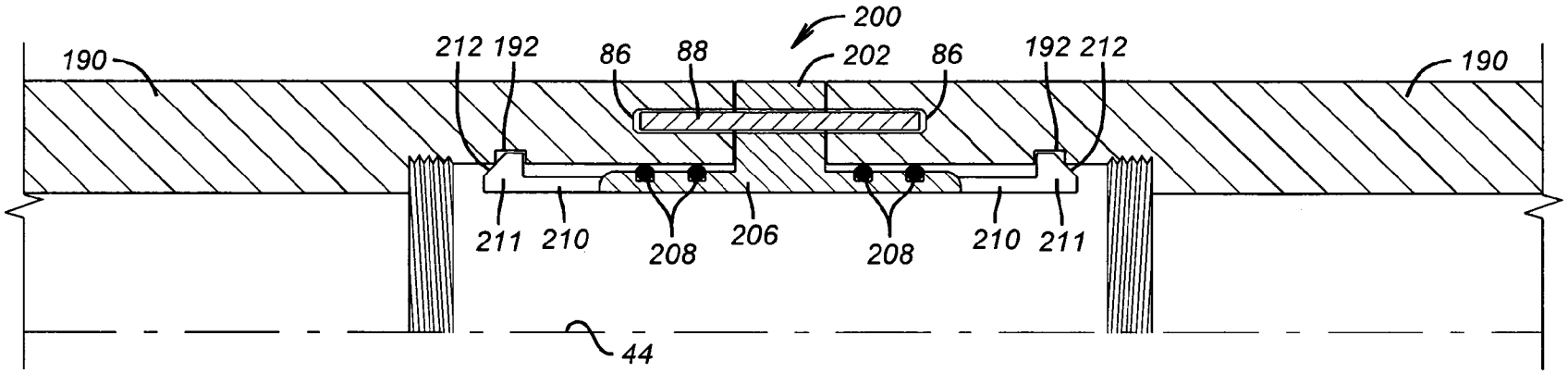
FIG. 25 is a half-section view of a fifth embodiment of the invention.
Figure 26:
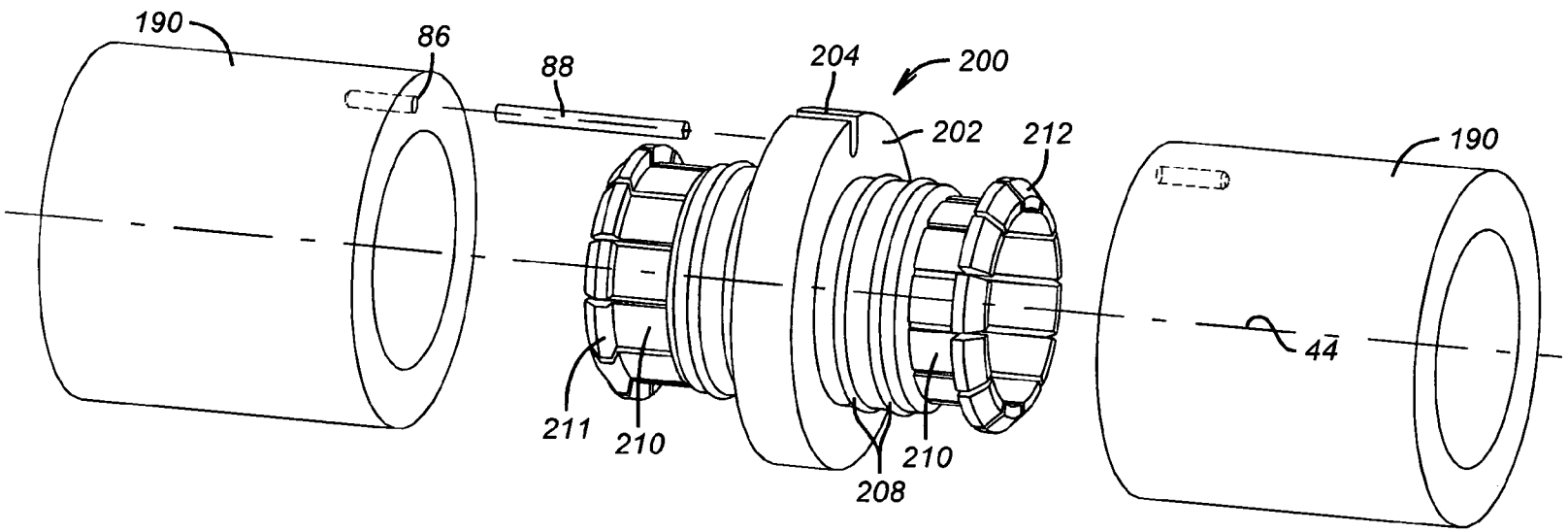
FIG. 26 is an axially exploded pictorial view of the fifth invention embodiment.

The connector embodiment of FIGS. 25 and 26 between transition collars 190 is angularly oriented by one or more alignment pins 88 that penetrate receptacle apertures 86 in the adjacent collar end-faces. At a predetermined distance from each collar end-face, a detent channel 192 is formed into the internal perimeter of the collar. Linking two transition collars 190 for a joint union is an internal collet connector 200. The collet connector 200 comprises an external collar 202 projecting radially out from the approximate mid-length of an internal sealing sleeve 206. Notches or apertures 204 across the collar 202 width accommodate a traverse of the alignment pins 88 past the collar 202.

The sealing sleeve 206 carries O-ring seals 208 on opposite sides of the collar 202 to engage the inside diameter surfaces of the respective transition collars 190. Projecting as integral extensions from the opposite ends of the sealing sleeve 206 are resilient collet fingers 210. Each collet finger 210 is terminated by a barb 211 having a ramped end-face 212.

Rig floor joint assembly of the FIGS. 25 and 26 embodiment assumes a preassembly of the internal collet connector 200 with one of the transition collars 190 respective to a joint union. The union is accomplished by an axial and rotational alignment of the two joints followed by a compressive translation between the joints. No disassembly means is provided for this embodiment.

Figure 27:
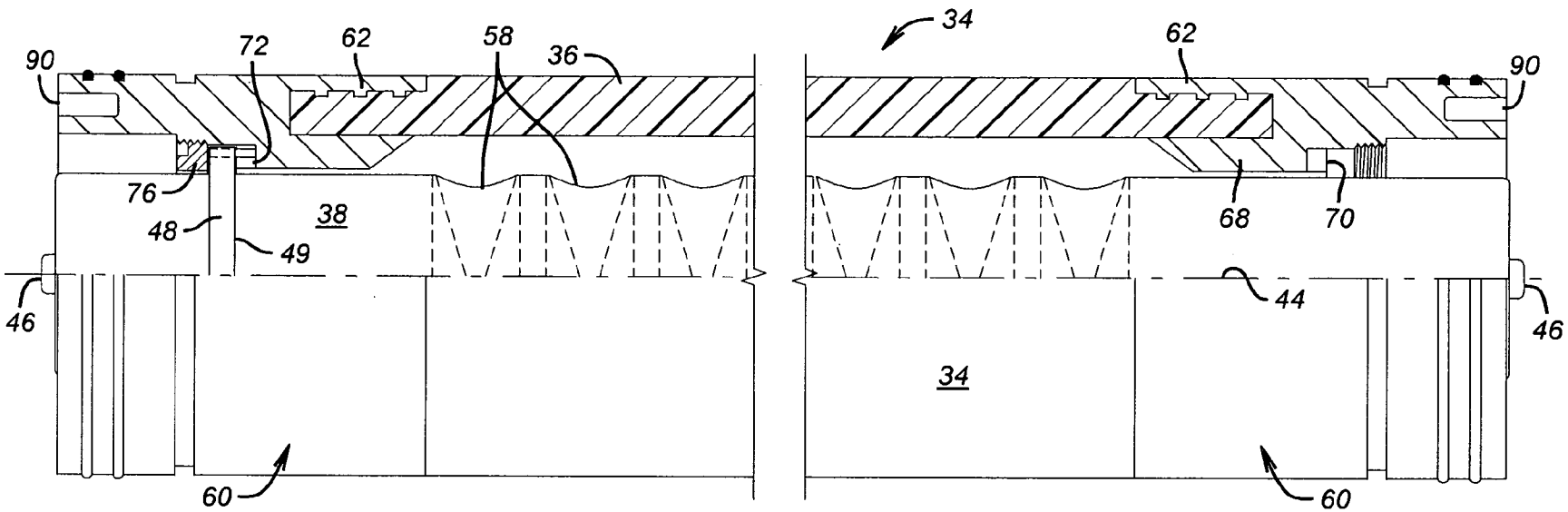
FIG. 27 is a half-section view of a charge carrier joint having an inner loading tube secured therein.
Figure 28:
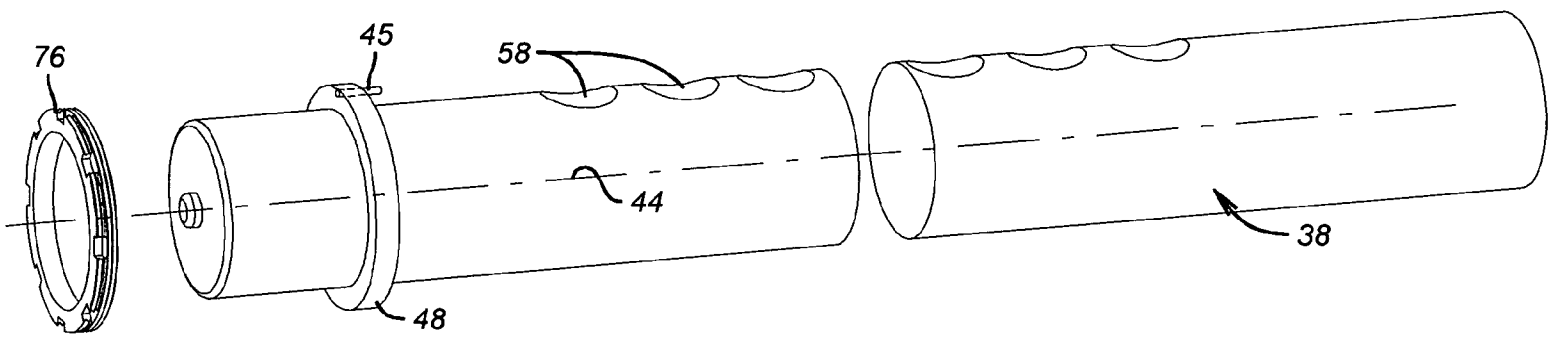
FIG. 28 is an axially exploded pictorial view of inner loading tube of the invention.

FIGS. 27 and 28 illustrate a preferred embodiment of the internal loading tube 38 as configured for assembly with all embodiments of the invention and as particularly illustrated with respect to the FIG. 3 invention embodiment. As designed for Controlled Buoyancy Perforating, the body of the inner loading tube 38 that provides direct contact alignment with a multiplicity of shaped charges 58 may be formed of a very light weight material such as a foamed plastic or glass. This preformed or molded body also encloses the fusing mechanism not shown for detonating each of the charges 58. The fusing mechanism links the detonation boosters 46 at opposite ends of the loading tube.

Critical dimensions in the loading tube 38 design and fabrication include the overall length of the tube relative to the opposite end faces of the charge carrier joint 34. When assembled, the boosters 46 must be within detonation transfer proximity of each other. To this end, the plane of seating ledge 70 is placed in relation to the joint end face to cooperate with the abutment face 49 of the alignment collar 48. The alignment collar 48 is secured to the length of the loading tube 38 body by such means as to maintain the required axial alignment throughout the downhole placement process.

When the internal loading tube 38 is inserted along the bore of a carrier housing 36, the surface 49 makes a contiguous planar engagement with the surface of seating ledge 70 in the transition collar 60. This planar abutment is secured by the threaded setting ring 76. If the internal diameters of the collar mandrels 60 are coordinated to a slip fit accommodation of the loading tube 38 outside diameter, no additional position control mechanism may be necessary. The union of two joints 34 necessarily aligns the shaped charge 58 discharge plane and places the respective detonation boosters 46 of a joint union within ignition proximity. Obviously, and internal snap ring not shown may be substituted for the threaded setting ring 76.

Although numerous embodiments of the invention have been described in detail, it will be recognized by those of ordinary skill in the art that numerous additional embodiments and permutations may be inspired by descriptions presented. In particular, those of skill in the art will recognize that the various invention features and characteristics distinctive to the metal collars respective to each of the several invention embodiments disclosed herein may be formed as integral elements of a composite pipe. Such features and/or characteristics may be molded or machined into an integrated composition. For example, the detent channels 172 of the FIG. 17 embodiment may be molded or turned into a composite pipe wall. Definition of the invention, therefore, is represented by those overarching principles described by the appended claims.

The invention claimed is:

1. A shaped charge carrier joint comprising the assembly combination of an inner loading tube disposed within an external housing, said inner loading tube providing a direct seating structure for shaped charge units and for operatively positioning shaped charge ignition means at opposite distal ends of said inner loading tube, said external housing having a first circumferential detent channel proximate opposite distal ends of said external housing, a sleeve circumscribing an external perimeter of a housing distal end, fluid sealing means between an inside surface of said sleeve and an outside surface of said housing distal end, a second circumferential detent channel circumscribing the inside perimeter of said sleeve at opposite distal ends of said sleeve, a snap ring having an annulus that radially bridges said first and second detent channels to secure a union between said sleeve and housing end and means for substantially displacing said snap ring annulus from one of said detent channels to release said sleeve from said housing distal end.

2. A shaped charge carrier joint as described by claim 1 wherein said means for displacing said snap ring annulus comprises a plurality of threaded apertures that penetrate said sleeve from an external perimeter thereof into said second detent channels, said threaded apertures having threaded rods therein for radially displacing said snap ring annulus from one of said detent channels.

3. A shaped charge carrier joint as described by claim 1 wherein said sleeve overlies a reduced external diameter portion of said external housing end, said detent channel being within said reduced diameter portion.

4. A shaped charge carrier joint as described by claim 1 wherein a pair of external housings are joined by said sleeve at a predetermined angular orientation about a substantially common axis and secured by angular alignment means.

5. A shaped charge carrier joint as described by claim 4 wherein said angular alignment means is an index pin penetrating both housings.

6. A shaped charge carrier joint comprising the end-to-end assembly of a pair of external housing tubes, each housing tube having an inner shaped charge loading tube therein, proximate of an assembly end of each housing tube of said pair is a first circumferential detent channel in the external perimeter of said tube ends, a sleeve circumscribing said external perimeter of said housing tube ends, said sleeve having a pair of second circumferential detent channels in the internal perimeter of said sleeve, said second detent channels having an axial separation distance corresponding to the axial separation distance of said first circumferential detent channels in said pair of external housing tubes when assembled end-to-end, a snap ring simultaneously occupying a portion of said first detent channel in one housing tube and one of said second detent channels to prevent axial displacement of said sleeve relative to said one housing tube, and means for substantially displacing said snap ring from one of said partially occupied detent channels to release said sleeve from said housing tube.

7. A shaped charge carrier joint as described by claim 6 wherein said means for displacing said snap ring comprises a plurality of threaded apertures penetrating said sleeve from an external perimeter thereof into said second detent channels, said threaded apertures having threaded rods therein for radially displacing said snap ring within one of said detent channels.

8. A shaped charge carrier joint as described by claim 6 having fluid sealing means between an external perimeter of said tube ends and an internal perimeter of said sleeve to restrain fluid entry into the interior of said housing tubes.

9. A shaped charge carrier joint as described by claim 6 wherein said sleeve overlies a reduced external diameter portion of said housing tube ends, said detent channels being within said reduced diameter portion.

10. A shaped charge carrier joint as described by claim 6 wherein a predetermined angular orientation between said pair of external housing tubes is secured by angular alignment means.

11. A shaped charge carrier joint as described by claim 10 wherein said alignment means is an index pin penetrating both housing tubes.

* * * * *